US005913777A

United States Patent [19]

Gerber

[11] Patent Number: 5,913,777

[45] Date of Patent: Jun. 22, 1999

[54] PRE-FABRICATED SHOWER MODULE AND METHOD OF SHOWER CONSTRUCTION

[75] Inventor: Lloyd A. Gerber, Parkland, Fla.

[73] Assignee: Tile Redi, Ltd., Coral Springs, Fla.

[21] Appl. No.: 08/855,869

[22] Filed: May 12, 1997

[51] Int. Cl.[6] ..... A47K 3/22; A47K 3/16

[52] U.S. Cl. ..... 52/35; 4/596; 4/613; 52/79.1; 52/390; 52/747.11

[58] Field of Search ..... 52/34, 35, 79.1, 52/390, 745.02, 745.13, 747.11; 4/596, 612, 613, 614

[56] References Cited

U.S. PATENT DOCUMENTS

| | | | |
|---|---|---|---|
| 2,055,173 | 9/1936 | Deubelbeiss | 4/613 |
| 2,757,385 | 8/1956 | Whittick | 4/613 |
| 3,992,825 | 11/1976 | May | 52/35 |
| 4,557,004 | 12/1985 | Piana . | |
| 4,694,513 | 9/1987 | Kiziah | 4/613 X |
| 5,261,130 | 11/1993 | Kendall | 4/613 |
| 5,299,330 | 4/1994 | Moore et al. | 4/612 X |
| 5,371,980 | 12/1994 | Dix | 52/35 X |
| 5,619,832 | 4/1997 | Myrvold | 52/403.1 |

*Primary Examiner*—Carl D. Friedman
*Assistant Examiner*—Kevin D. Wilkens
*Attorney, Agent, or Firm*—Malin, Haley, DiMaggio & Crosby, P.A.

[57] ABSTRACT

A waterproof shower module comprising a pre-fabricated, integrally molded unit which forms a unitary base having side walls and a pitched floor defining an opening within which is incorporated a vertically adjustable drain. Each side wall includes an upper lip forming a horizontal surface upon which wall board may be supported and flushly aligned with the side walls of the module such that a substantially continuous and uniform surface is formed which provides a suitable mounting surface for receiving shower tiles. The module floor includes a top surface and a bottom surface and defines a plurality of molded feet depending from the bottom surface, which feet function to support the module floor on the underlying subfloor. The module floor is uniformly pitched from each side wall to the drain opening. One of the side walls further defines a curb and includes inner and outer curb surfaces and a horizontal and curb surface. Tile installed on the module's surfaces and on the surrounding wall board. A method of installing a tiled shower using a pre-fabricated shower module.

10 Claims, 7 Drawing Sheets

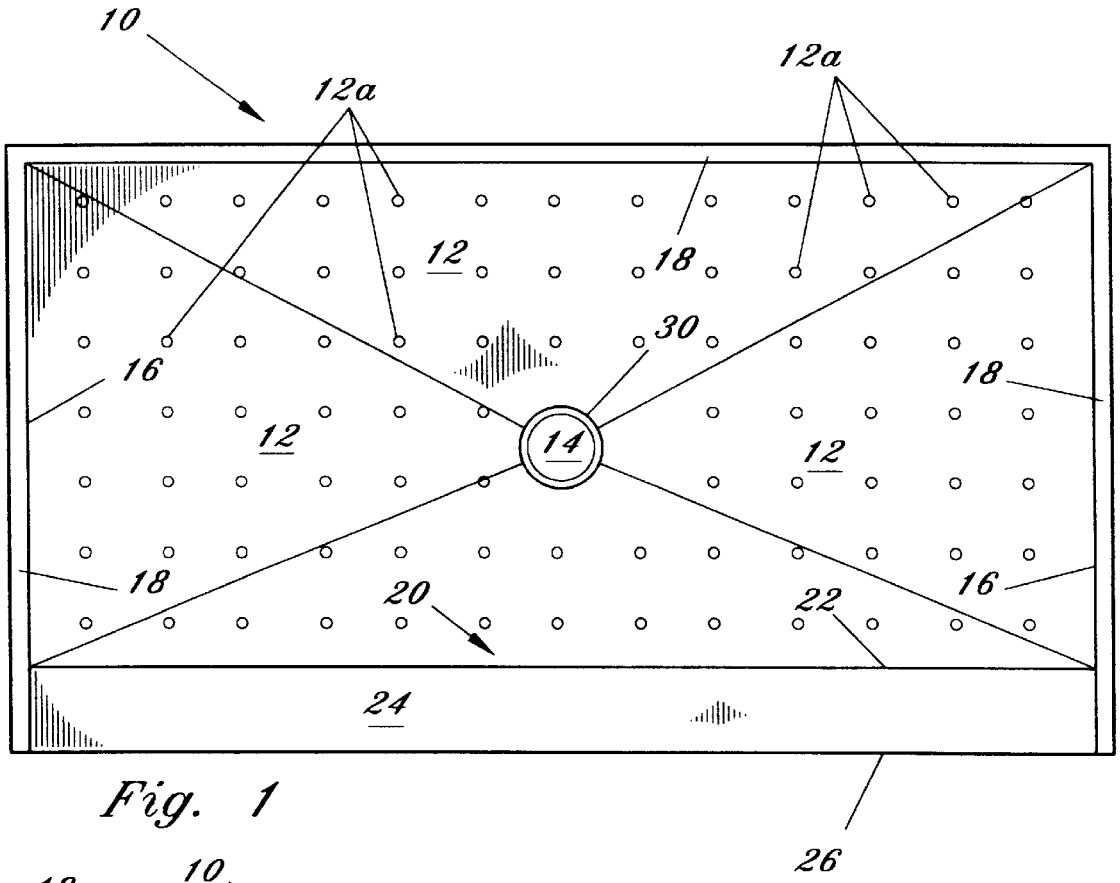
Fig. 1
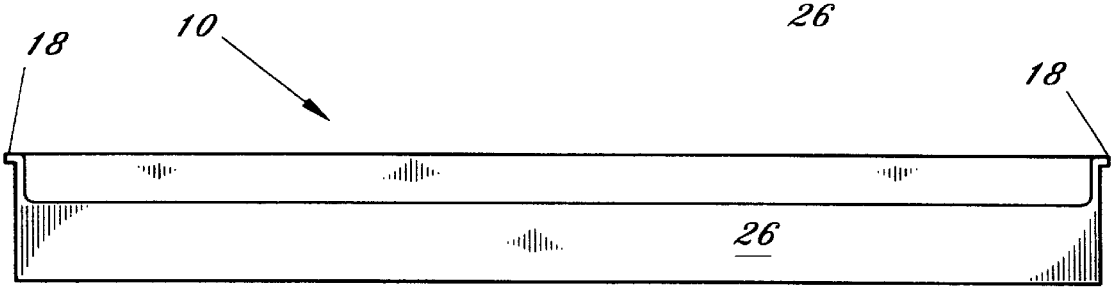
Fig. 2
Fig. 3
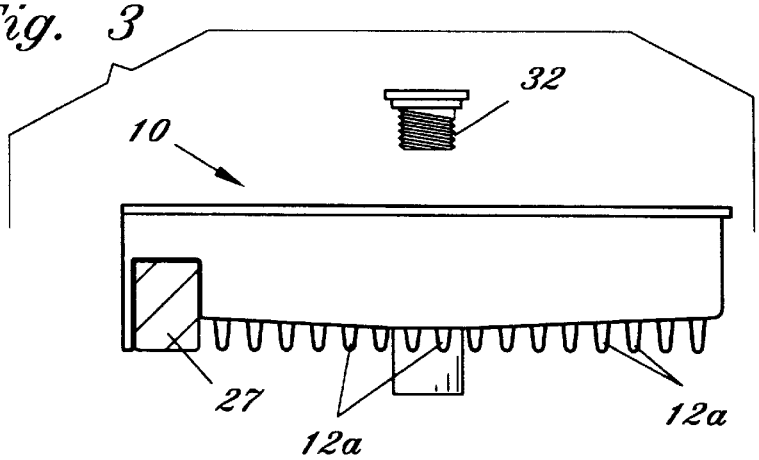

PRE-FABRICATED SHOWER MODULE AND METHOD OF SHOWER CONSTRUCTION

BACKGROUND OF THE INVENTION

1. Field of the Invention

The present invention relates to prefabricated shower modules, and particularly, to a pre-molded waterproof shower module capable of being mounted flush with surrounding wall board and having surfaces for receiving shower tile or stone installed thereon.

2. Description of the Background Art

The installation of showers according to methods common in the background art is inefficient. Conventional shower installations typically involve complicated constructions using flexible shower pan liners. According to the conventional method, showers are formed by: framing the shower with wooden two by four members thereby forming a frame and curb; covering the subfloor with felt or tar paper; installing a liner comprising a flexible sheet of waterproof material over the felt or tar paper floor by folding and fastening the sides of the material to the two by fours members with suitable fasteners; creating a hole in the liner to provide for a drain; installing dry wall; applying a layer of mortar (commonly referred to as "mud") to the shower sidewalls and curb and allowing the mud to cure; applying additional mud to form a properly pitched shower floor and allowing the floor mud to cure; and, after the shower has been formed and cured, installing suitable shower tile contiguous with adjacent wall board to create a finished shower.

Problems with the conventional method of shower fabrication include the formation of bulging corners caused by folding of the liner, which bulging corners may cause irregularities in the side walls of the shower that are difficult to tile over resulting in a non-uniform finish. In addition, conventional shower liners are susceptible to puncture by various objects and foot traffic until covered with tile. Furthermore, the installation of tile is complicated by irregularities in the side walls and by the sloping shower floor. Still another problem with conventional methods of shower fabrication is difficulties experienced by the installer in forming substantially square corners. Further still, with conventional shower construction, the pitch of the floor may not be satisfactory, thereby causing the formation of puddles of water that do not properly drain.

Accordingly, there exists a need for a pre-fabricated shower module that allows for the efficient construction of a shower while avoiding the disadvantages present in conventional methods of shower fabrication.

SUMMARY OF THE INVENTION

A pre-fabricated shower module comprising a prefabricated, integrally molded unit which forms a unitary base having side walls, and a pitched floor defining a drain opening into which is incorporated a vertically adjustable drain. Each side wall includes an upper lip forming a horizontal surface upon which suitable wall board may be supported and flushly aligned with the side walls of the module such that a substantially continuous and uniform surface is formed which provides a suitable mounting surface for receiving shower tiles. The module floor includes a top surface and a bottom surface and defines a plurality of molded feet depending from the floor, which feet function to support the module floor on an underlying floor. The depending feet further result in the formation of a plurality of depressions in the floor top surface, which depressions facilitate the installation of shower tile by providing a surface suitable for receiving and securing shower tile mortar. The module floor is pitched as needed from each side wall to a drain opening. One of the side walls further defines a curb and includes inner and outer curb surfaces and a horizontal curb surface. In the preferred embodiment, the horizontal curb surface is at a lower elevation than the remaining side walls of the module such that, in the event of a clog in the drain, rising water would flow over the curb rather than reach a level where water would potentially damage the wall board supported by the side wall lips. The module surfaces and side walls are roughly textured so that they are well adapted for holding tiles or stone attached thereto by means of thinset adhesive.

The shower module further includes an integrally formed, vertically adjustable drain. The adjustable drain facilitates the installation of shower tile of varying thickness for providing a drain having a perforated drain plate that is flush with the surrounding tile.

Installation of the shower module involves first adhesively securing a section of drain pipe, such as PVC, to the module using a suitable adhesive. The installer then places ample amounts of adhesive and sealing material, known as "bull" material, on the subfloor where the module will sit. In addition, an ample quantity of bull material is placed on the subfloor around the drain opening to seal the opening. Next, the module is set in place making sure the side wall lips are substantially adjacent to the two by four studs which frame the shower. The installer then seats the module in place, such as by placing his weight on the module floor to insure secure and proper seating. Wall board, such as drywall, may then be installed and secured to the two by four studs such that the lower edges of the wall board are substantially adjacent to the side wall lips and flush with the module's side walls. Next, wall covering such as tile may be installed. Significantly, no mudding is required prior to installing the tile since the module is flush with the wall board. In addition, tile is easily installed as the bottom row of tile sits perfectly along the floor's upper surface. In contrast, the installation of tile is complicated in conventional shower installations having mud floors since the uneven mud floor surface requires the tile installer to make appropriate adjustments so that the bottom row of tile is level. Additional tile is then installed on the floor of the module and on the horizontal and vertical curb surfaces.

It has been found that installation of the shower module of the present invention results in substantial savings in both time and material. Specifically, installation of a shower using the module of the present invention results in the saving of substantial quantities of wall mud and floor mud, which would have been required if the conventional method were employed, as well as several hours of labor. Finally, an installation using the module of the present invention insures a uniform installation having perfectly square corners. The shower module of the present invention is fabricated from a durable, waterproof, material that provides a completely leak-proof shower module, having surfaces suitable for receiving shower tile thereon.

Accordingly, it is an object of the present invention to provide a shower module which provides for the efficient installation of a finished, tiled, shower.

Yet another object of the present invention is to provide a waterproof shower module which, when installed, provides side walls terminating in a supporting peripheral lip for supporting wallboard flush with the module side walls.

Still another object of the present invention is to provide a waterproof shower module having a floor which is supported by a plurality of integrally molded feet thereby providing a rigid shower floor capable of having shower tile mounted thereon.

Yet another object of the present invention is to provide a waterproof shower module which includes a molded curb having a horizontal surface and a vertical surface, which surfaces each provide a mounting surface for the installation of shower tile.

Still another object of the present invention is to provide a waterproof shower module having a vertically adjustable drain assembly for accommodating shower tiles of various thicknesses.

In accordance with these and other objects which will become apparent hereinafter, the instant invention will now be described with particular reference to the accompanying drawings.

BRIEF DESCRIPTION OF THE DRAWINGS

FIG. 1 is a top plan view of a shower module of the present invention;

FIG. 2 is a front elevational view of the shower module shown in FIG. 1;

FIG. 3 is a right side elevational view of the shower module;

DESCRIPTION OF THE PREFERRED EMBODIMENTS

Figures 4, 5:
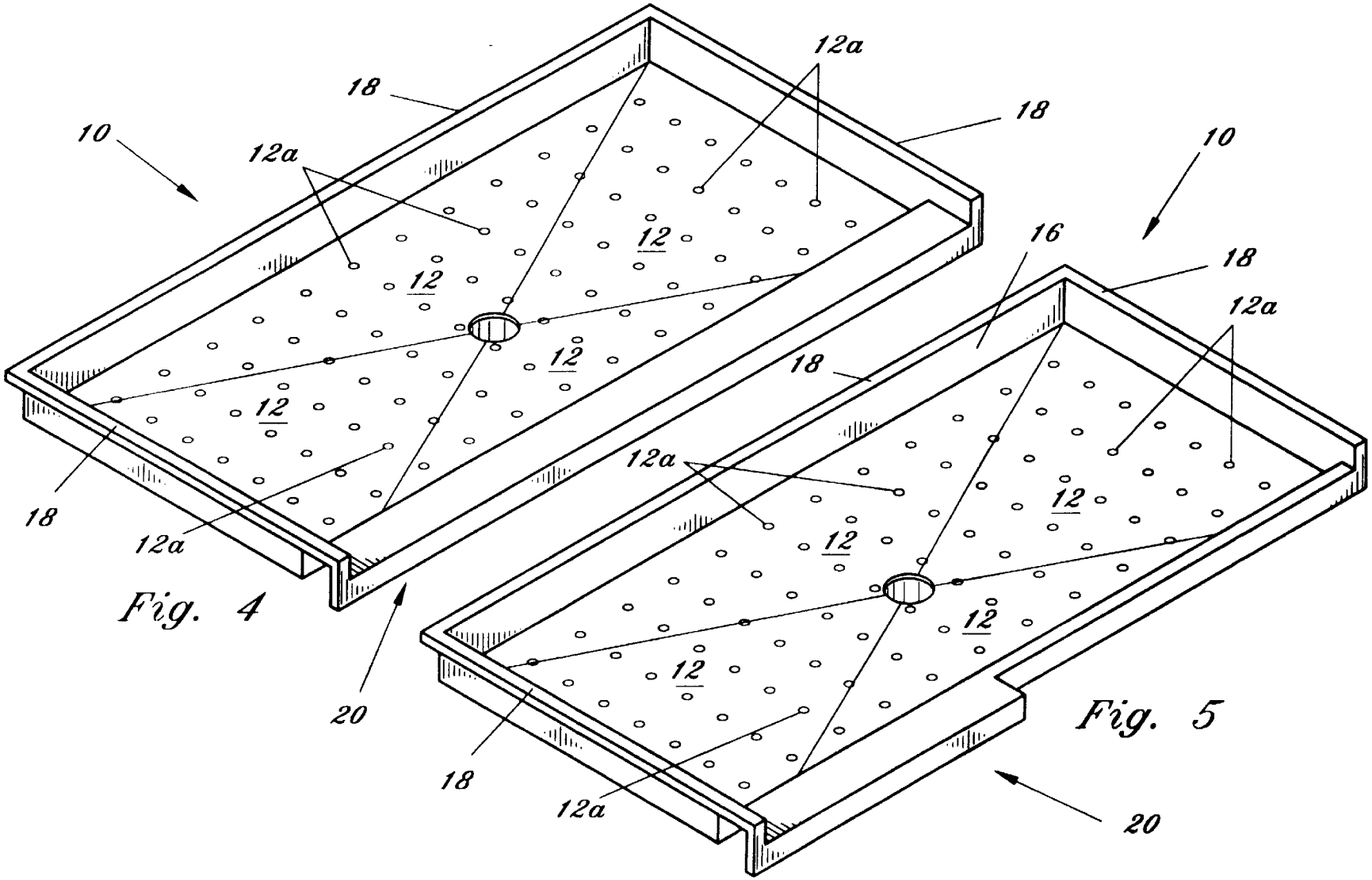
FIG. 4 is a front top perspective view of the shower module.
FIG. 5 is a front top perspective view of an alternate embodiment of the present invention.

With reference now to the drawings, FIGS. 1–3 depict a preferred embodiment of the shower module of the present invention, generally referenced as 10. Shower module 10 includes: a floor 12, forming a plurality of integrally formed molded feet 12*a,* defining a drain opening 14; a peripheral side wall 16 defining an upper peripheral lip 18; a curb, generally referenced as 20, and including an inner vertical curb surface 22, a horizontal curb surface 24 and an outer vertical curb surface 26. Floor 12, side wall 16, and curb 20 are joined to form an integral waterproof module. Module 10 is fabricated from a durable, lightweight, waterproof material and may be formed by a vacuum molding process to the desired shape. In the preferred embodiment, shower module 10 is fabricated from Noryl Resin EN-185 which material is available from General Electric Corporation.

The module floor 12 is sloped from the surrounding side wall 16 toward the drain opening 14. In the preferred embodiment, floor 12 slopes approximately ¾" from the surrounding side wall 16 to drain opening 14, however, any suitable slope is considered within the scope of the invention. Floor 12 further forms a plurality of integral, downwardly depending, molded feet 12*a*. Molded feet 12*a* function as load bearing members to support floor 12 thereby preventing deflection. In the preferred embodiment, feet 12*a* are spaced three inches on center, however, any suitable spacing which prevents significant deflection of the module floor is considered within the scope of the invention. As best depicted in FIG. 3, sloping floor 12 requires that feet 12*a* vary in overall length such that each foot 12*a* will be in supporting contact with the level underlying subfloor.

Side wall 16 is approximately 6" high, as measured from the intersection of floor 12 and side wall 16. Each side wall 16 terminates in a horizontal lip 18. In the preferred embodiment, lip 18 forms a horizontal surface of at least ½" and is preferably approximately ¾". As is more fully discussed herein below, lip 18 functions as a ledge for the mounting of wallboard flushly with side wall 16.

Shower module 10 is further shaped such that one side thereof defines a curb 20 along at least a portion that side's length. Curb 20 includes an inner vertical curb surface 22, a horizontal curb surface 24, and an outer vertical curb surface 26. In the preferred embodiment, inner vertical curb surface 22 has a dimension of approximately 4¼" in height as measured from floor 12, horizontal curb surface 24 has a dimension of approximately 4⅝", and outer vertical curb surface 26 has a dimension of approximately 5" such that surface 26 terminates substantially adjacent to the underlying subfloor. Curb 20 includes a quantity of support material 27, such as expanded polystyrene, enclosed by surfaces 22, 24, and 26, as best depicted in FIG. 3.

In the preferred embodiment, a vertically adjustable drain assembly, including an outer drain member 30, is disposed within drain opening 14 in a watertight manner. Outer drain member 30 defines internal threads suitable for threaded engagement with an externally threaded inner drain member 32 having a perforated drain plate 34. Outer drain member 30 is suitable for connection to drain piping components for draining water from the shower. As is apparent inner drain member 32 is threadably engaged with outer drain member 30 such that rotation of inner member 32 causes vertical adjustment of inner member 32, and particularly plate 34, for positioning plate 34 flush with surrounding shower tile.

Figure 6:
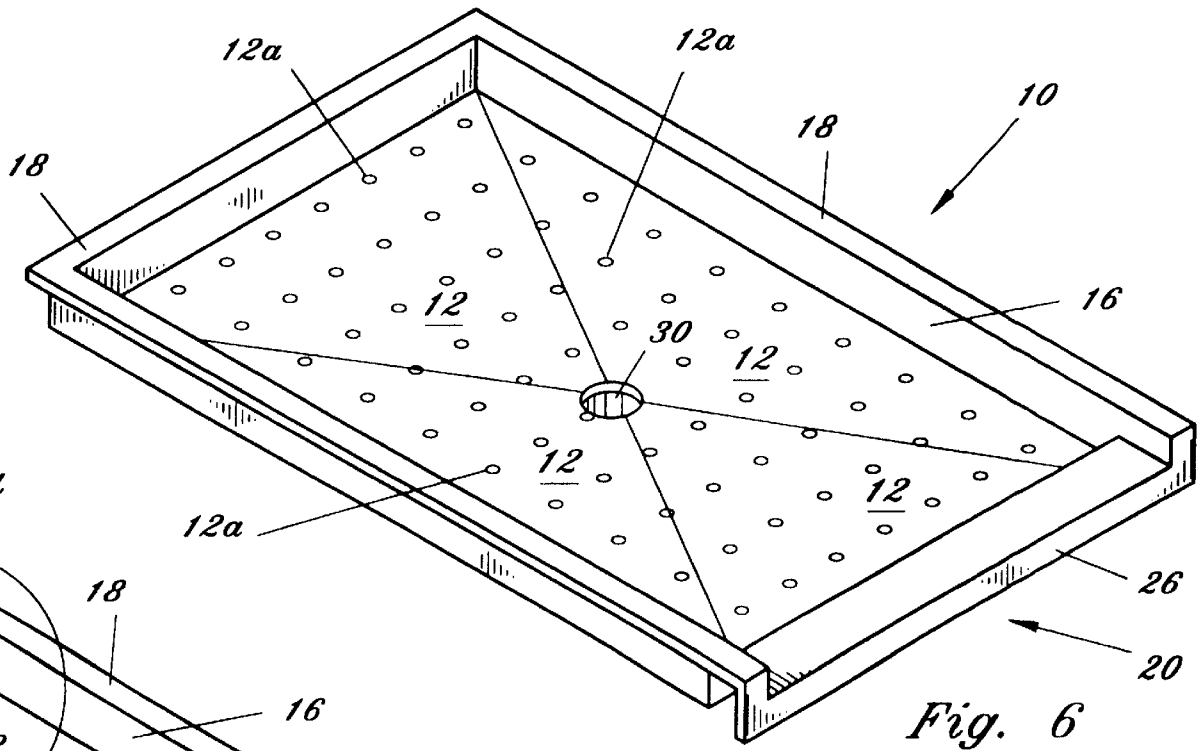
FIG. 6 is a front top perspective view of another alternate embodiment of the present invention.
Figure 7A:
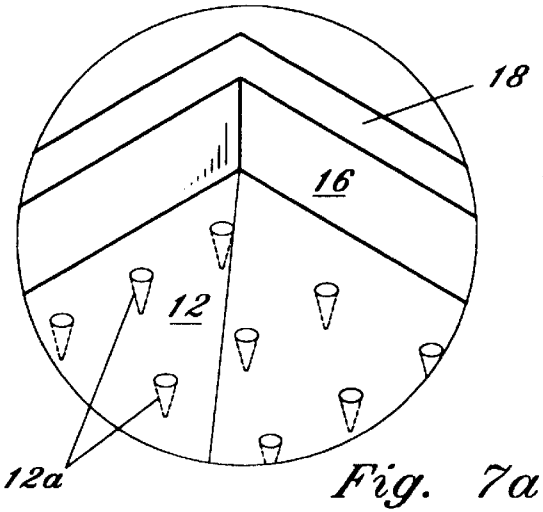
FIG. 7*a* is an enlarged perspective view of a portion of that of FIG. 7.
Figure 7:
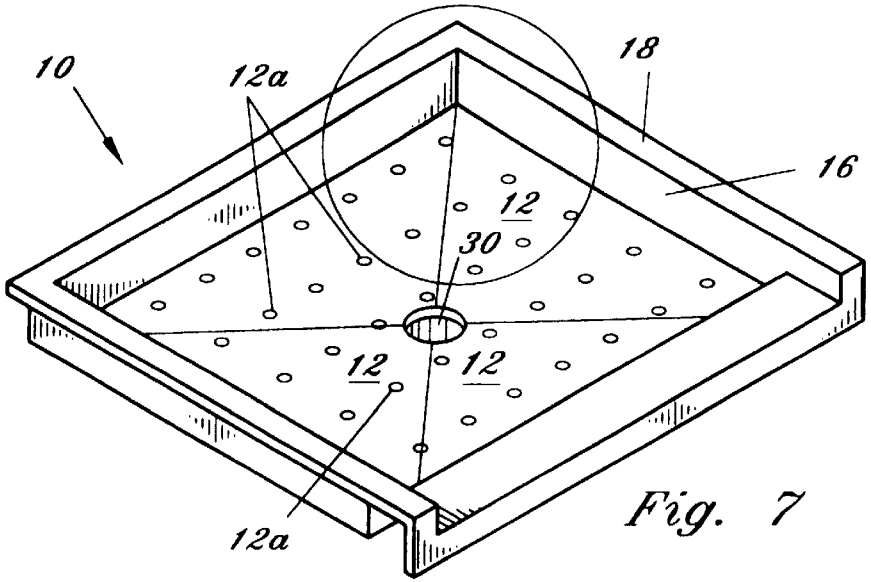
FIG. 7 is a front top perspective view of yet another alternate embodiment of the present invention.
Figure 8A:
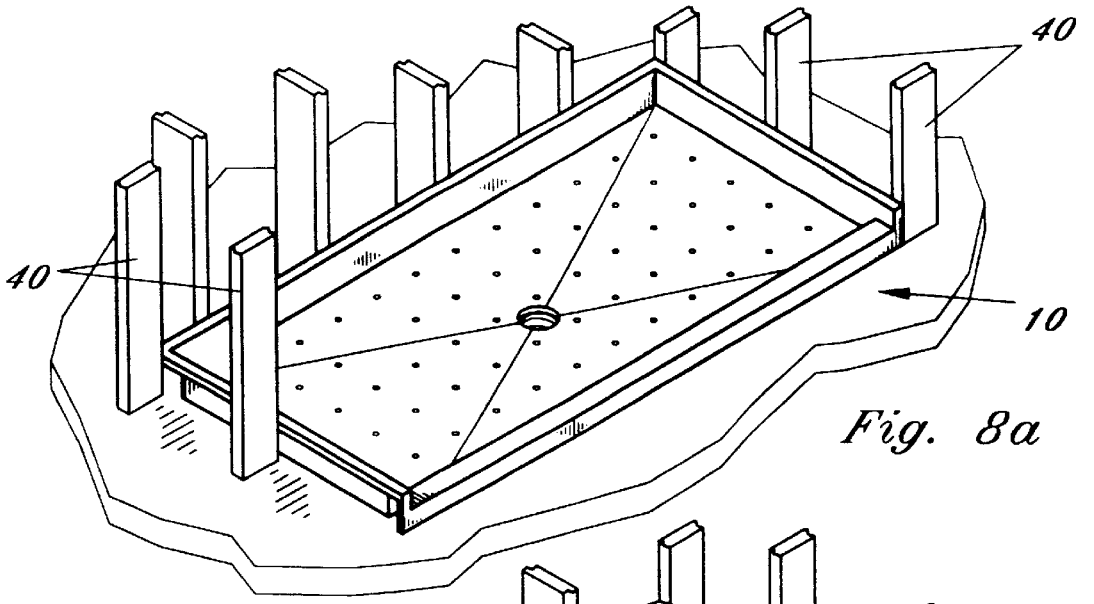
FIGS. 8*a–c* illustrate the shower module of the present invention during installation thereof.
Figure 8B:
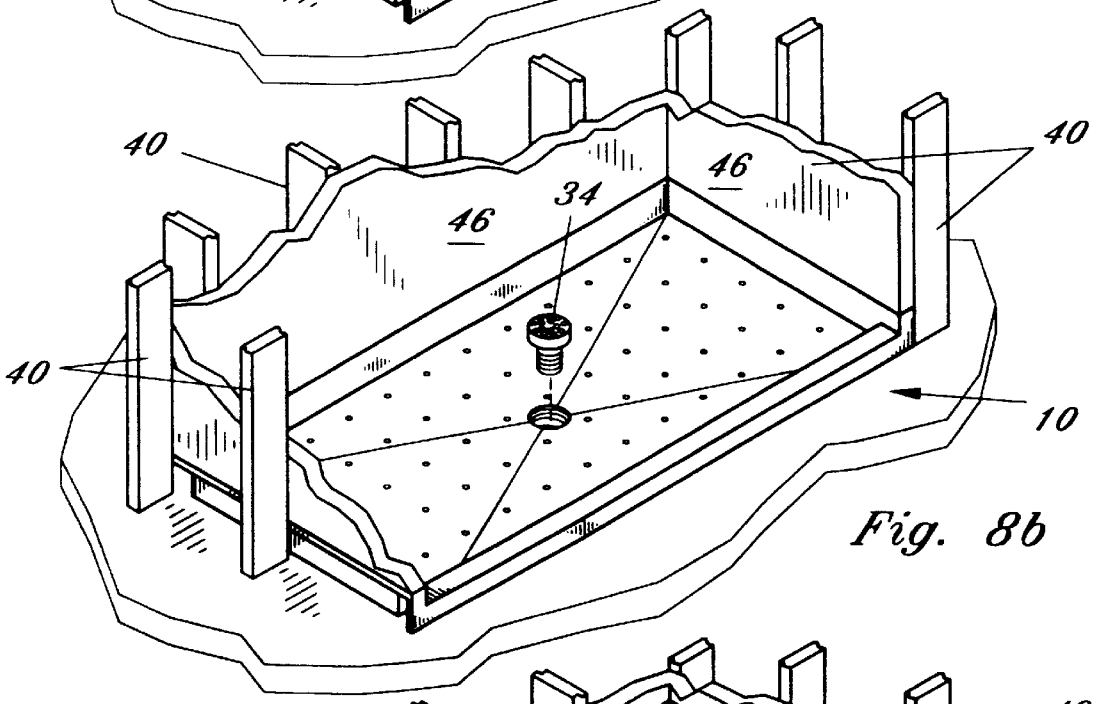
Figure 8C:
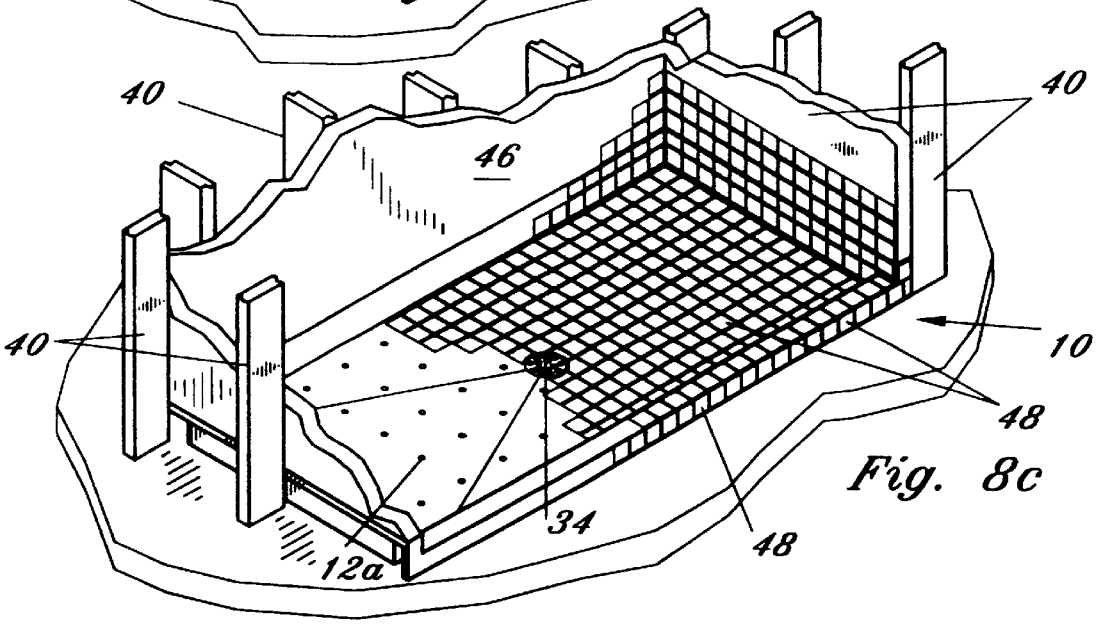

FIG. 5 depicts an alternate embodiment of the shower module 10 of the present invention wherein curb 20 extends partially along one side of the module. FIG. 6 depicts an alternate embodiment of the shower module of the present invention wherein curb 20 is positioned on a "short" side of the module 10. FIGS. 7 and 7*a* depict an alternate embodiment of the shower module of the present invention which is substantially square. Accordingly, any suitably dimensioned shower module is considered within the scope of the present invention.

In each embodiment, the module's floor, side walls, and curb surfaces are capable of having ceramic tile or marble installed directly thereto using a suitable thin set mortar, bonding material, or other suitable adhesive material.

Installation of the shower module of the present invention is best illustrated in FIGS. 8*a–c* and 9*a* and 9*b*. The shower module 10 of the present invention is installed in a shower area, that has been previously framed by suitable studs 40 (hereinafter "studs"), by first adhesively securing a section of drain pipe 42, such as PVC, to the module using a suitable adhesive. The drain pipe will route water draining from the finished shower through suitable drain piping in the structure, and ultimately to a sanitary sewer.

The installer then places ample amounts of adhesive and sealing material, known as "bull" material 44 on the subfloor where the module will sit, and an ample quantity of bull material is placed around the drain opening to seal the opening from water penetration. Next, the module 10 is set in place making sure the side wall lip 18 is substantially adjacent to the studs 40. The installer then secures the module and insures proper seating thereof by placing weight on the module floor. This may be accomplished by the installer simply walking on the floor 12 of module 10. Next, wallboard 46, such as suitable drywall, is then installed and secured to studs 40 such that the lower edges of the wallboard are substantially adjacent to the side wall lip 18 and flush with the surrounding side wall 16.

Next, shower tile 48 may be installed over wallboard 46 and the modules surfaces. Significantly, no mudding is required prior to installing the shower tile since the module is flush with the wallboard. In addition, shower tile 48 is easily installed in a level manner as the bottom row of tile is easily affixed to the modules side walls 16 since the tiles rest in perfect horizontal alignment on the floor's upper surface. In contrast, the installation of shower tile is complicated in conventional shower installations having mud floors since the uneven mud floor surface requires the tile installer to make appropriate adjustments so that the bottom row of tile is level. Additional shower tile is then installed on the module floor 12 and on the horizontal curb surface 24 and the vertical curb surfaces 22 and 26.

Figure 9A:
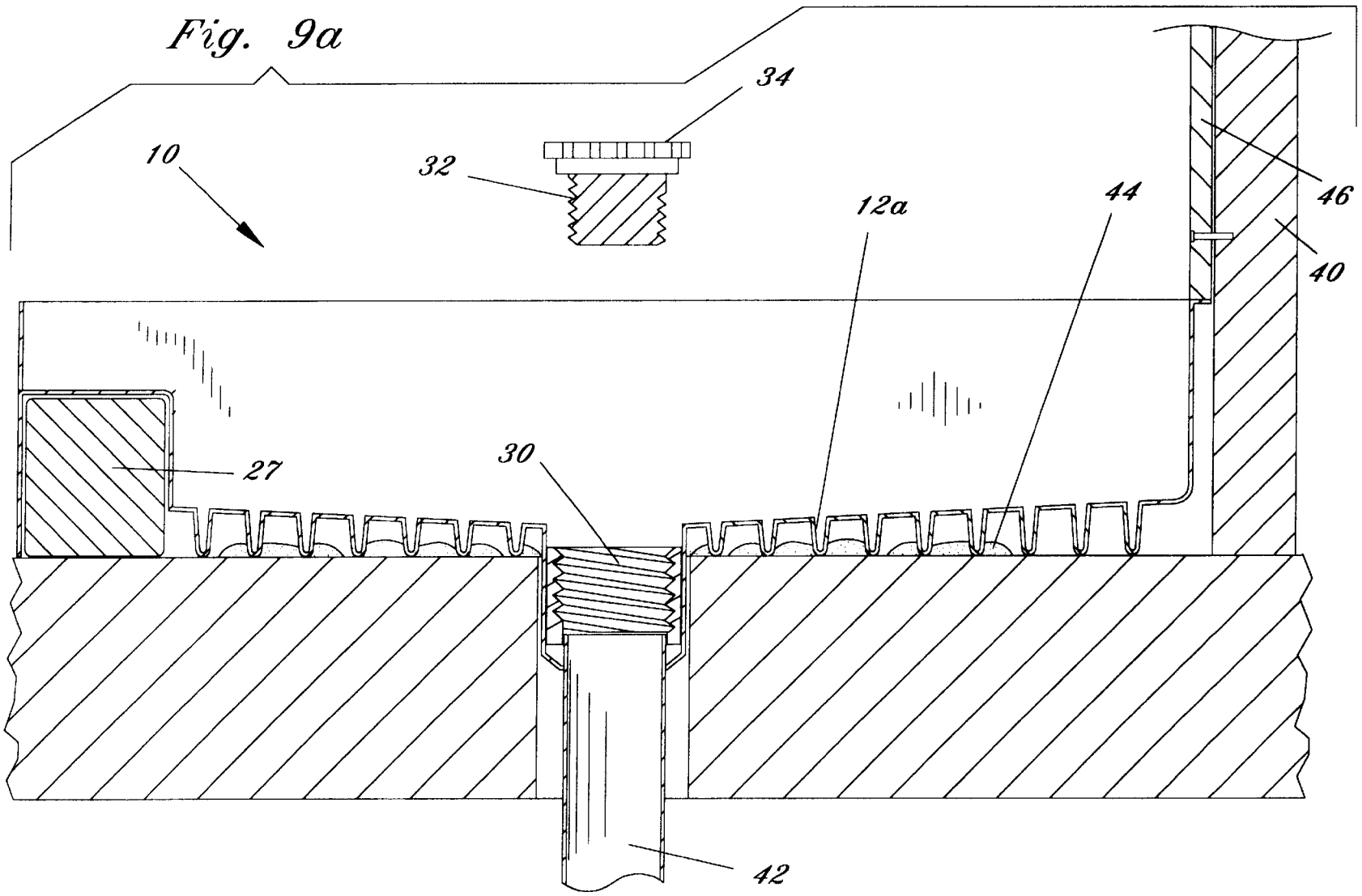
FIG. 9*a* is a sectional view of the shower module resting on a supporting subfloor.
Figure 9B:
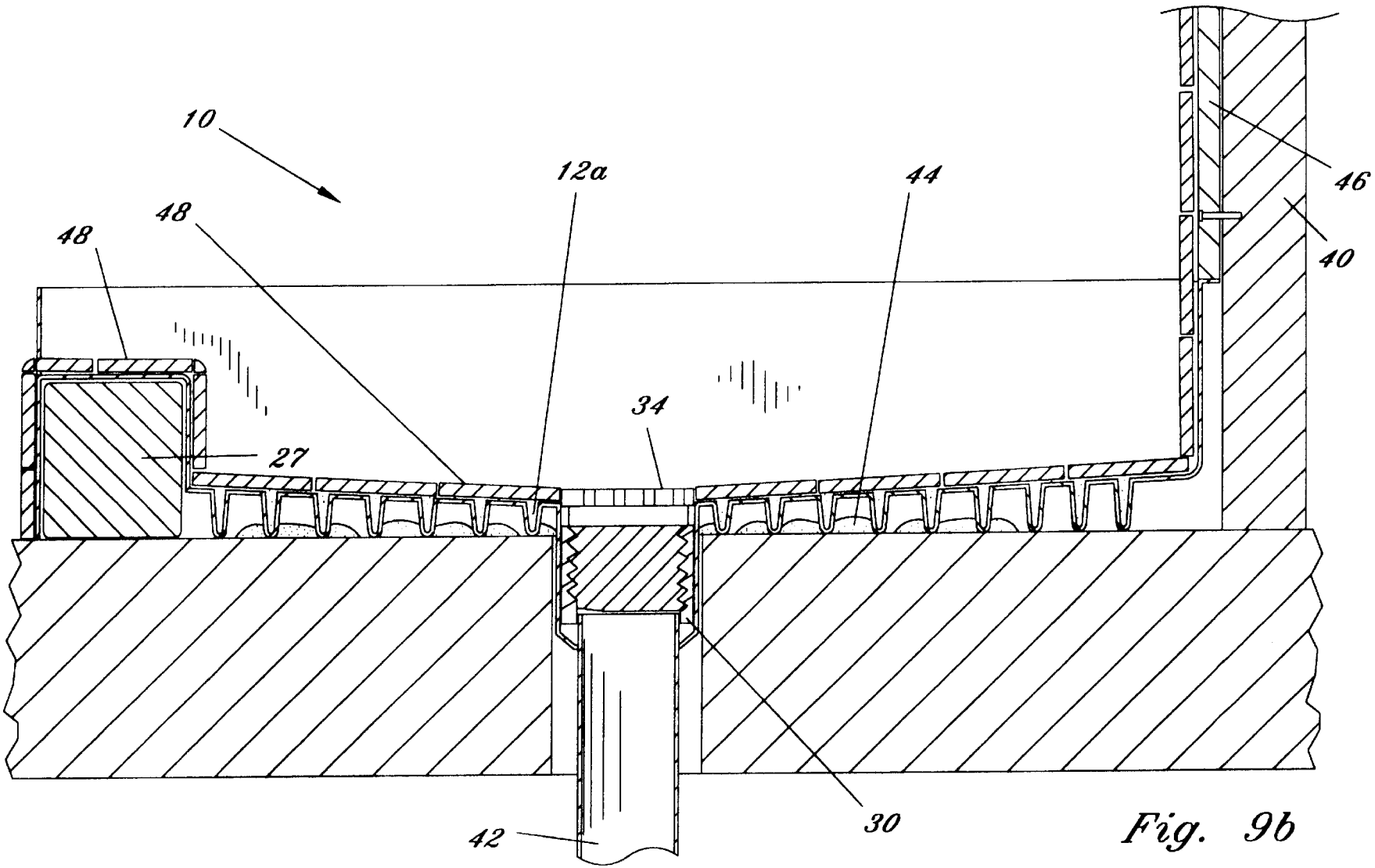
FIG. 9*b* is a sectional view of the shower module of FIG. 9*a,* having shower tile installed thereon.
Figures 10, 11A, 11B, 11C:
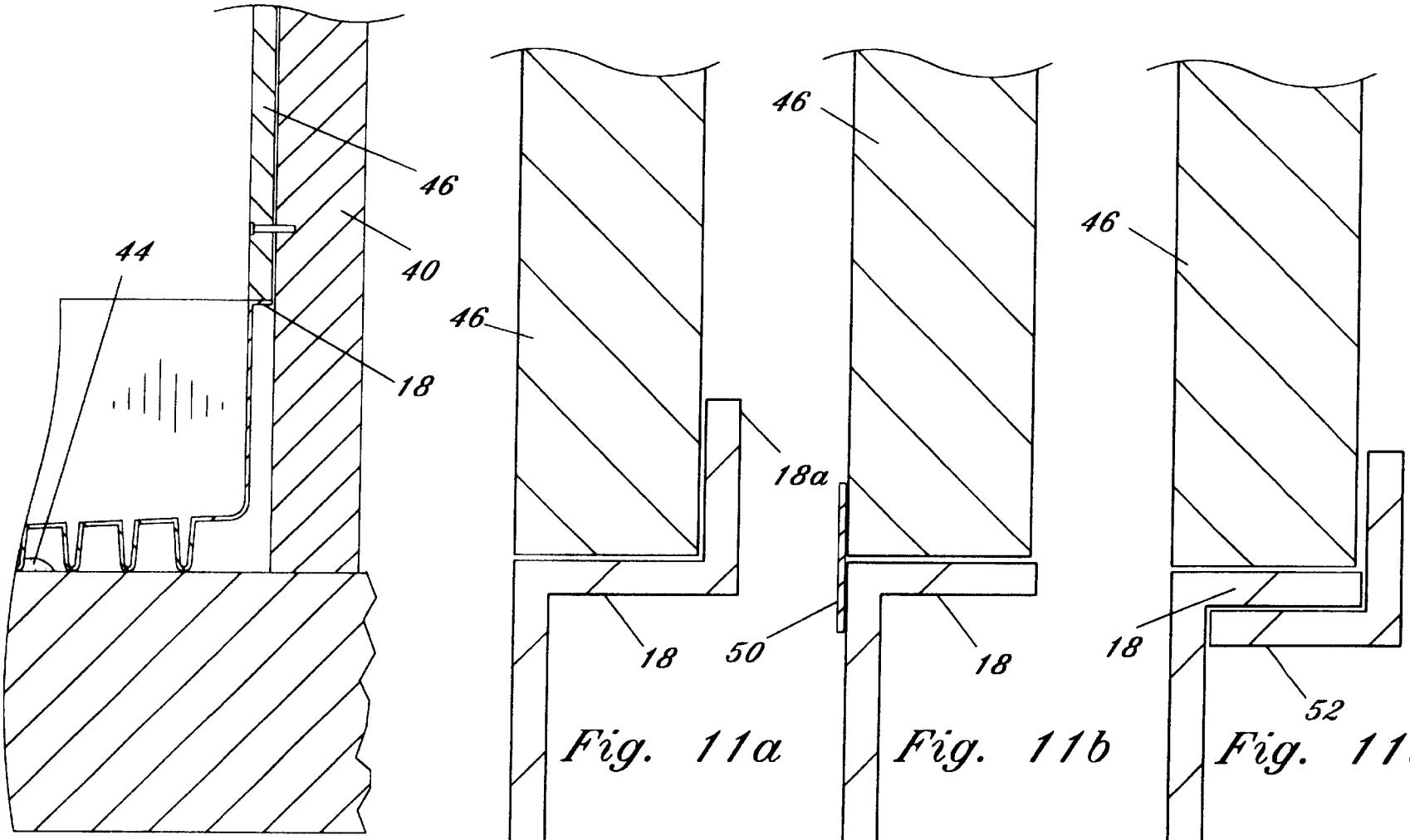
FIG. 10 is a more detailed view of a portion of the shower module shown in FIG. 9*a*.
FIGS. 11*a–c* illustrate alternate embodiments of the lip structure of the shower module.

FIG. 10 depicts a partial view of the shower module of FIG. 9*a* detailing the lip and wall board structures. FIGS. 11*a–c* depict alternate embodiments of the lip 18 structure and assembly. Specifically, FIG. 11*a* depicts a horizontal lip 18 having a vertically extending portion 18*a* which is behind wallboard 46 for preventing water from getting behind the module/wallboard structure. FIG. 11*b* depicts an alternate installation wherein a membrane 50 is placed over wallboard 46 and side wall 16 to prevent water from getting behind the module/wallboard structure. FIG. 11*c* depicts yet another alternate embodiment wherein a rigid L-shaped member 52 is sealing connected to lip 18 to prevent water from getting behind the module/wallboard structure.

As is now apparent, the shower module of the present invention provides an efficient molded waterproof module for facilitating the construction and installation of a shower. Use of the module in shower construction, in lieu of conventional construction methods, results in substantial savings in both material and labor. Furthermore, a shower constructed using the shower module of the present invention is more durable than a shower constructed using conventional methods and results in a higher quality installation and more uniform finish.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A waterproof shower module for use in constructing a tiled shower within an area bounded by a subfloor and stud framing, said shower module comprising:

a prefabricated, integrally molded unit forming a unitary module having a floor bounded along a peripheral edge by a side wall and a curb, said side wall extending vertically from said peripheral edge of said floor and terminating in a horizontal lip;

said floor having an upper surface sloping downward from said peripheral edge to a drain aperture, said floor further defining a plurality of downwardly depending support feet, said downwardly depending support feet each terminating below said floor upper surface in a common horizontal plane, each of said downwardly depending support feet defining a cavity in said floor upper surface for retaining tile adhesive;

said curb formed along at least a portion of said floor peripheral edge, said curb defined by an inner surface extending upward from said peripheral floor edge, a horizontal surface connected to said inner surface, and an outer surface connected to said horizontal surface and extending downwardly therefrom, said outer surface terminating at said horizontal plane.

2. A waterproof shower module according to claim 1, wherein said horizontal lip has a horizontal dimension of at least ½".

3. A waterproof shower module according to claim 2, wherein said horizontal lip has a vertically extending portion.

4. A waterproof shower module according to claim 1, further including a vertically adjustable drain disposed within said floor drain aperture.

5. A waterproof shower module according to claim 1, further including a quantity of polystyrene within a void defined by said curb inner vertical surface, horizontal surface, and outer vertical surface.

6. A waterproof shower module for use in constructing a tiled shower within an area bounded by a subfloor and stud framing, said subfloor including a plumbing connection communicating with a sewer line, said shower module comprising:

a prefabricated, integrally molded unit forming a unitary module having a floor bounded along a peripheral edge by a side wall and a curb, said side wall extending vertically from said peripheral edge and terminating in a horizontal lip;

said floor having an upper surface with a downward slope from said peripheral edge to a drain aperture, said floor further defining a plurality of downwardly depending support feet, said downwardly depending support feet each terminating below said floor upper surface for supporting said floor upon the subfloor, each of said downwardly depending support feet defining a cavity in said floor upper surface for retaining tile adhesive;

a vertically adjustable drain disposed within said drain aperture;

said curb formed along at least a portion of said floor peripheral edge, said curb defined by an inner surface extending upward from said peripheral floor edge, a horizontal surface connected to said inner surface, and an outer surface connected to said horizontal surface and extending downwardly therefrom, said outer surface adapted to terminate substantially adjacent to the subfloor;

whereby said module is adapted to be installed on the subfloor with said feet in supporting engagement with said subfloor and at least a portion of said lip substantially adjacent to the stud framing such that wall board affixed to said framing is supportable by said lip flush with said side wall, and whereby said drain is fluidly connectable to said subfloor plumbing connection for draining shower water to a sanitary sewer.

7. A waterproof shower module according to claim 6, wherein said downward slope from said peripheral edge to said drain aperture comprises a change in vertical elevation of approximately ¾".

8. A waterproof shower module according to claim 6, wherein said horizontal lip has a horizontal dimension of at least ½".

9. A waterproof shower module according to claim 6, wherein said floor, said side wall, and said curb, each define surfaces suitable for receiving shower tile installed thereon.

10. A method of installing a tiled shower within an area bounded by a subfloor and stud framing, said subfloor including a plumbing connection communicating with a sewer line, said method including the steps of:

applying a quantity of adhesive material on the subfloor within the area bounded by the stud framing;

setting a pre-fabricated shower module in place on the subfloor within the area bounded by the stud framing;

said module comprising: a prefabricated, integrally molded unit forming a unitary module having a floor bounded along a peripheral edge by a side wall and a curb, said side wall extending vertically from said peripheral edge and terminating in a horizontal lip; said floor having an upper surface with a downward slope from said peripheral edge to a drain aperture, said floor further defining a plurality of downwardly depending support feet, said downwardly depending support feet each terminating below said floor upper surface for supporting said floor upon the subfloor, and each of said downwardly depending support feet defining a cavity in said floor upper surface for retaining tile adhesive; a vertically adjustable drain disposed within said drain aperture; said curb formed along at least a portion of said floor peripheral edge, said curb defined by an inner surface extending upward from said peripheral floor edge, a horizontal surface connected to said inner surface, and an outer surface connected to said horizontal surface and extending downwardly therefrom, said outer surface terminating substantially adjacent to the subfloor;

whereby said module is positioned on the subfloor such that said feet are in supporting engagement with said subfloor and at least a portion of said lip is substantially adjacent to the stud framing, and said drain is in fluid communication with the subfloor plumbing connection;

fixing wall board to said framing such that at least a portion of said wall board is supported by said module lip and is flush with said module side wall;

installing tile on said wall board and said module side wall, said floor, and said curb, thereby resulting in a tiled shower.

* * * * *